US008865381B2

(12) United States Patent
Tanaka et al.

(10) Patent No.: US 8,865,381 B2
(45) Date of Patent: Oct. 21, 2014

(54) ELECTROPHOTOGRAPHIC PHOTOSENSITIVE MEMBER, METHOD FOR PRODUCING ELECTROPHOTOGRAPHIC PHOTOSENSITIVE MEMBER, PROCESS CARTRIDGE, AND ELECTROPHOTOGRAPHIC APPARATUS

(75) Inventors: Masato Tanaka, Tagata-gun (JP); Yuka Ishiduka, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 284 days.

(21) Appl. No.: 13/203,703

(22) PCT Filed: Apr. 20, 2010

(86) PCT No.: PCT/JP2010/057320

§ 371 (c)(1),
(2), (4) Date: Aug. 26, 2011

(87) PCT Pub. No.: WO2010/123134

PCT Pub. Date: Oct. 28, 2010

(65) Prior Publication Data

US 2012/0033994 A1 Feb. 9, 2012

(30) Foreign Application Priority Data

Apr. 23, 2009 (JP) ..... 2009-104859
Apr. 14, 2010 (JP) ..... 2010-093134

(51) Int. Cl.

| | |
|---|---|
| ***G03G 15/04*** | (2006.01) |
| ***G03G 5/14*** | (2006.01) |
| ***G03G 5/06*** | (2006.01) |
| ***G03G 5/05*** | (2006.01) |
| ***G03G 5/147*** | (2006.01) |

(52) U.S. Cl.

CPC ..... *G03G 5/144* (2013.01); *G03G 5/0614* (2013.01); *G03G 5/0696* (2013.01); *G03G 5/0571* (2013.01); *G03G 5/14769* (2013.01)

USPC ..... 430/60; 430/64; 430/65; 399/159

(58) Field of Classification Search

USPC ..... 430/60, 64, 65; 399/159

See application file for complete search history.

(56) References Cited

U.S. PATENT DOCUMENTS

| | | | |
|---|---|---|---|
| 4,518,669 | A | 5/1985 | Yashiki |
| 4,963,450 | A | 10/1990 | Miyazaki et al. |

(Continued)

FOREIGN PATENT DOCUMENTS

| | | | |
|---|---|---|---|
| EP | 1 179 752 | A2 | 2/2002 |
| JP | 59-31962 | A | 2/1984 |

(Continued)

OTHER PUBLICATIONS

European Search Report dated Jan. 18, 2012 in European Application No. 10767186.9.

(Continued)

*Primary Examiner* — Thorl Chea

(74) *Attorney, Agent, or Firm* — Fitzpatrick, Cella, Harper and Scinto

(57) ABSTRACT

An electrophotographic photosensitive member is provided in which both a long-term potential variation and a short-term potential variation are suppressed, a method for producing the electrophotographic photosensitive member, and a process cartridge and an electrophotographic apparatus each having the electrophotographic photosensitive member are also provided. An intermediate layer of the electrophotographic photosensitive member is formed by applying a coating liquid for the intermediate layer, which contains an organic resin and a rutile-type acidic titania sol containing tin, and drying the applied coating liquid.

11 Claims, 1 Drawing Sheet

(56) References Cited

U.S. PATENT DOCUMENTS

| | | | | |
|---|---|---|---|---|
| 5,194,353 | A | 3/1993 | Tanaka et al. | |
| 5,246,807 | A | 9/1993 | Kanemaru et al. | |
| 5,453,342 | A | 9/1995 | Go et al. | |
| 5,464,718 | A | 11/1995 | Kashizaki et al. | |
| 5,527,653 | A | 6/1996 | Tanaka | |
| 5,571,648 | A | 11/1996 | Mishra et al. | |
| 5,629,116 | A | 5/1997 | Kashizaki et al. | |
| 5,666,589 | A | 9/1997 | Yoshinaga et al. | |
| 5,744,271 | A | 4/1998 | Aizawa et al. | |
| 5,811,212 | A | 9/1998 | Tanaka | |
| 5,818,489 | A | 10/1998 | Yoshinaga et al. | |
| 6,040,100 | A | 3/2000 | Tanaka et al. | |
| 6,139,997 | A | 10/2000 | Tanaka et al. | |
| 6,143,453 | A | 11/2000 | Sugimura et al. | |
| 6,183,922 | B1 | 2/2001 | Takai et al. | |
| 6,190,811 | B1 | 2/2001 | Tanaka et al. | |
| 6,218,063 | B1 | 4/2001 | Tanaka et al. | |
| 6,245,472 | B1 | 6/2001 | Tanaka | |
| 6,248,490 | B1 | 6/2001 | Suzuki et al. | |
| 6,270,936 | B1 | 8/2001 | Tanaka et al. | |
| 6,335,132 | B1 | 1/2002 | Tanaka et al. | |
| 6,472,524 | B2 | 10/2002 | Tanaka | |
| 6,683,175 | B2 | 1/2004 | Tanaka | |
| 6,773,856 | B2 | 8/2004 | Tanaka et al. | |
| 6,833,227 | B2 | 12/2004 | Tanaka | |
| 6,991,881 | B2 | 1/2006 | Ogaki et al. | |
| 6,994,941 | B2 | 2/2006 | Tanaka et al. | |
| 7,001,699 | B2 | 2/2006 | Tanaka et al. | |
| 7,245,851 | B2 | 7/2007 | Fujii et al. | |
| 7,276,318 | B2 | 10/2007 | Fujii et al. | |
| 7,333,752 | B2 | 2/2008 | Kawahara et al. | |
| 7,517,626 | B2 | 4/2009 | Fujii et al. | |
| 7,910,274 | B2 | 3/2011 | Tanaka et al. | |
| 8,064,796 | B2 | 11/2011 | Mitsumori et al. | |
| 8,481,236 | B2 * | 7/2013 | Tanaka et al. | 430/60 |
| 2006/0188798 | A1 * | 8/2006 | Tokutake et al. | 430/60 |
| 2008/0026210 | A1 * | 1/2008 | Iijima et al. | 428/338 |
| 2009/0041500 | A1 | 2/2009 | Mitsumori et al. | |
| 2009/0053634 | A1 | 2/2009 | Mitsumori et al. | |
| 2009/0123176 | A1 | 5/2009 | Tanaka et al. | |
| 2009/0208247 | A1 | 8/2009 | Tanaka et al. | |
| 2009/0291379 | A1 | 11/2009 | Oota et al. | |
| 2010/0316411 | A1 | 12/2010 | Mitsumori et al. | |
| 2010/0316412 | A1 | 12/2010 | Mitsumori et al. | |
| 2011/0045390 | A1 | 2/2011 | Tanaka | |
| 2011/0293323 | A1 | 12/2011 | Tanaka et al. | |

FOREIGN PATENT DOCUMENTS

| | | | |
|---|---|---|---|
| JP | 59-84257 | A | 5/1984 |
| JP | 1-183663 | A | 7/1989 |
| JP | 8-87124 | A | 4/1996 |
| JP | 9-90661 | A | 4/1997 |
| JP | 2000-66432 | A | 3/2000 |
| JP | 2001-42553 | A | 2/2001 |
| JP | 2002-148826 | A | 5/2002 |
| JP | 2004-126444 | A | 4/2004 |
| JP | 2004-302462 | A | 10/2004 |
| JP | 2005-221923 | A | 8/2005 |
| JP | 2007-148357 | A | 6/2007 |
| JP | 2007-246351 | A | 9/2007 |
| JP | 2008-129218 | A | 6/2008 |
| WO | 2007/114396 | A1 | 10/2007 |

OTHER PUBLICATIONS

Tanaka, et al., U.S. Appl. No. 13/153,318, filed Jun. 3, 2011.

PCT International Search Report and Written Opinion of the International Searching Authority, International Application No. PCT/JP2010/057320, Mailing Date Jun. 22, 2010.

Chinese Office Action dated Oct. 30, 2012 in Chinese Application No. 201080017636.7.

* cited by examiner

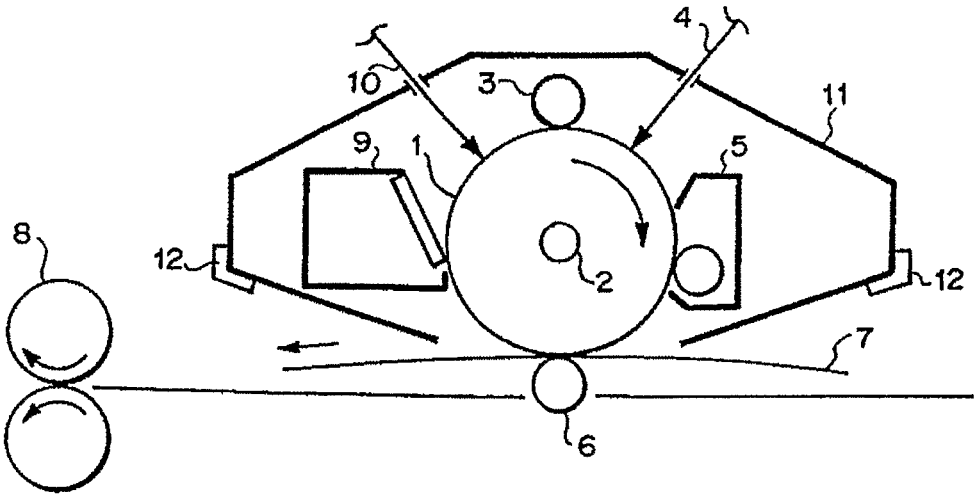
4
10
3
11
9
1
5
8
12
2
12
7
6

ELECTROPHOTOGRAPHIC PHOTOSENSITIVE MEMBER, METHOD FOR PRODUCING ELECTROPHOTOGRAPHIC PHOTOSENSITIVE MEMBER, PROCESS CARTRIDGE, AND ELECTROPHOTOGRAPHIC APPARATUS

TECHNICAL FIELD

The present invention relates to an electrophotographic photosensitive member, a method for producing the electrophotographic photosensitive member, a process cartridge, and an electrophotographic apparatus.

BACKGROUND ART

An electrophotographic photosensitive member using an organic photoconductive substance (organic electrophotographic photosensitive member) has the advantages over an electrophotographic photosensitive member which uses an inorganic photoconductive substance (inorganic electrophotographic photosensitive member) of being easier to produce, and having a higher degree of freedom in functional design because the materials for the organic electrophotographic photosensitive member can be selected from a large variety of materials. With the rapid spread of laser beam printers in recent years, such an organic electrophotographic photosensitive member has come to be widely used in the market.

A typical electrophotographic photosensitive member has a support and a photosensitive layer formed on the support. In addition, a laminated photosensitive layer formed by superimposing in order from the support side a charge-generating layer containing a charge-generating substance and a hole-transporting layer containing a hole-transporting substance is often used as a photosensitive layer.

In addition, an intermediate layer is often provided between the support and the photosensitive layer for the purpose of, for example, covering defects on the surface of the support, improving adhesion between the support and the photosensitive layer, suppressing an interference fringe, protecting the photosensitive layer from electrical breakdown, and inhibiting holes from being injected from the support into the photosensitive layer.

Although such an intermediate layer has the above-mentioned merits, it also has the drawback that charge tends to accumulate in the intermediate layer. When image formation is repeatedly performed for a long time period, the accumulation of charge in the intermediate layer can increase potential variation, which can cause problems in output images.

Japanese Patent Application Laid-Open No. 2005-221923 and No. 2007-148357 disclose a technique for alleviating potential variation or suppressing interference fringe by incorporating surface-treated titanium oxide particles which have a small particle size into an intermediate layer.
However, there is still room for improvement in terms of potential variation when image formation is repeatedly performed for a long time period.

In addition, Japanese Patent Application Laid-Open No. 559-84257, No. H09-90661, and No. 2000-66432 disclose a technique for reducing potential variation such as an increase in residual potential or a reduction in initial potential when image formation is repeatedly performed by using an electrophotographic photosensitive member having an intermediate layer. Under the existing circumstances, deterioration in initial sensitivity or deterioration in chargeability may occur, and thus there are still problems which have not been sufficiently solved.

With the increased speed, improved image quality, and trend towards full color of electrophotographic apparatuses in recent years, a problem has arisen in that when image formation is repeatedly performed, potential variation (variation in dark potential (charge potential) or light potential) is suppressed to a greater extent. Specific examples of potential variation include the following.

(1) Potential variation over a relatively long-term (a time period from when the electrophotographic photosensitive member starts to be used until the electrophotographic photosensitive member reaches the end of its life).

(2) Potential variation over a relatively short-term (for example, a time period from the first sheet until about 1,000 sheets in continuous image formation).

There is a need to suppress such potential variation to a greater extent.

Concerning the above item (1), in general, the longer the time period for which the electrophotographic photosensitive member is used, the larger the deterioration in the potential characteristic of the electrophotographic photosensitive member is. Even when the electrophotographic photosensitive member which has already been used for a long time period is left to stand, a possibility is low that the potential characteristic returns to the state at the time of the initiation of the use of the electrophotographic photosensitive member. Accordingly, it can be said that the recoverability of the long-term potential variation described in the above item (1) is insufficient.

Concerning the above item (2), for example, although the electrophotographic photosensitive member rotates several times for forming an image on an A4 size sheet of paper, the potential characteristic of the electrophotographic photosensitive member fluctuates in the sheet, and hence the tint or density of an output image may change. In addition, when outputting the same image on multiple sheets, the density of the image may be different between the first sheet and the n-th sheet (where n>1). Such a short-term potential variation becomes prominent when image formation is performed under a low-humidity environment.

Such short-term potential variation recovers to some extent by leaving the electrophotographic photosensitive member to stand after the use of the electrophotographic photosensitive member.

The long-term potential variation described in the above item (1), which has insufficient recoverability, is thought to be caused by gradual accumulation of variations which are left unrestored in the electrophotographic photosensitive member from repeated use as described in the above item (2).

The electrophotographic photosensitive member should be able to perform image formation stably at all times while suppressing both the long-term potential variation described in the above item (1) and the short-term potential variation described in the above item (2).

SUMMARY OF THE INVENTION

Objectives of the present invention are to provide an electrophotographic photosensitive member in which both a long-term potential variation and a short-term potential variation are suppressed, a method for producing the electrophotographic photosensitive member, and a process cartridge and an electrophotographic apparatus each having the electrophotographic photosensitive member.

Specifically, the present invention is an electrophotographic photosensitive member, including a support, an intermediate layer formed on the support, a charge-generating layer containing a charge-generating substance, formed on the intermediate layer, and a hole-transporting layer containing a hole-transporting substance, formed on the charge-generating layer, wherein the intermediate layer is a layer formed by applying a coating liquid for an intermediate layer, which contains an organic resin and a rutile-type acidic titania sol containing tin, and drying the applied coating liquid.

Further, the present invention is a method for producing an electrophotographic photosensitive member including: an intermediate layer-forming step of forming an intermediate layer on a support; a charge-generating layer-forming step of forming a charge-generating layer containing a charge-generating substance on the intermediate layer; and a hole-transporting layer-forming step of forming a hole-transporting layer containing a hole-transporting substance on the charge-generating layer, wherein the intermediate layer-forming step is a step of forming the intermediate layer by applying a coating liquid for the intermediate layer, which contains an organic resin and a rutile-type acidic titania sol containing tin, and drying the applied coating liquid.

In addition, the present invention relates to a process cartridge which integrally holds the electrophotographic photosensitive member described above and at least one unit selected from the group consisting of a charging unit for charging the surface of the electrophotographic photosensitive member, a developing unit for developing an electrostatic latent image formed on the surface of the electrophotographic photosensitive member with toner to form a toner image on the surface of the electrophotographic photosensitive member, and a cleaning unit for removing the toner remaining on the surface of the electrophotographic photosensitive member after the toner image has been transferred onto a transfer material, the process cartridge being detachably mountable on a main body of an electrophotographic apparatus.

Further, the present invention relates to an electrophotographic apparatus, including: the electrophotographic photosensitive member described above, a charging unit for charging the surface of the electrophotographic photosensitive member, an exposure unit for irradiating the charged surface of the electrophotographic photosensitive member with exposure light to form an electrostatic latent image on the surface of the electrophotographic photosensitive member, a developing unit for developing the electrostatic latent image on the surface of the electrophotographic photosensitive member with toner to form a toner image on the surface of the electrophotographic photosensitive member, and a transferring unit for transferring the toner image formed on the surface of the electrophotographic photosensitive member onto a transfer material.

According to the present invention, an electrophotographic photosensitive member can be provided in which both a long-term potential variation and a short-term potential variation are suppressed, and a method for producing the electrophotographic photosensitive member and a process cartridge and an electrophotographic apparatus each having the electrophotographic photosensitive member are also provided.

Further features of the present invention will become apparent from the following description of exemplary embodiment with reference to the attached drawings.

BRIEF DESCRIPTION OF THE DRAWING

FIG. 1 illustrates an example of the basic configuration of an electrophotographic apparatus including a process cartridge having an electrophotographic photosensitive member according to the present invention.

DESCRIPTION OF THE PREFERRED EMBODIMENTS

An electrophotographic photosensitive member of the present invention includes: a support; an intermediate layer formed on the support; a charge-generating layer containing a charge-generating substance, formed on the intermediate layer; and a hole-transporting layer containing a hole-transporting substance, formed on the charge-generating layer.

The electrophotographic photosensitive member of the present invention is characterized in that the above intermediate layer is a layer formed by applying a coating liquid for an intermediate layer, which contains an organic resin and a rutile-type acidic titania sol containing tin, and drying the applied coating liquid.

The rutile-type acidic titania sol containing tin is an acidic sol containing rutile-type titanium oxide crystal particles (particles of rutile-type titanium oxide crystals), which further contain tin. This tin is contained in a form in which it replaces part of the titanium atoms in titanium oxide of rutile-type titanium oxide crystal particles. The under-mentioned zirconia is contained in the same form as this tin.

The rutile-type acidic titania sol containing tin used in the present invention is obtained by hydrolyzing a water-soluble titanium salt, such as titanium oxychloride, titanium tetrachloride and titanium sulfate, neutralizing the resultant product with an alkali to produce a water-containing titanium oxide, adding tin oxide to the water-containing titanium oxide, and adding an acid to effect peptization. Further, the rutile-type acidic titania sol containing tin according to the present invention can also be obtained by hydrolyzing a mixed aqueous solution of a tin salt, such as tin chloride and tin sulfate, and a water-soluble titanium salt, then neutralizing the resultant product with an alkali to produce a water-containing titanium oxide, and adding an acid to effect peptization.

The rutile-type acidic titania sol containing tin used in the present invention may also be referred to below as "rutile-type acidic titania sol according to the present invention".

From the perspective of suppressing potential variation without causing charging performance to deteriorate, the rutile-type acidic titania sol according to the present invention preferably includes rutile-type titanium oxide crystal particles having an average primary particle diameter of 3 nm or more to 9 nm or less.

The average primary particle diameter of the crystal particles is referred to also as "average crystallite diameter".

From the viewpoint of effectively suppressing a long-term potential variation and a short-term potential variation, the molar ratio (Sn/Ti) of tin to titanium in the rutile-type acidic titania sol according to the present invention is preferably 0.02 or more to 0.12 or less.

Further, from the perspective of stability of the coating liquid for an intermediate layer, the rutile-type acidic titania sol according to the present invention preferably includes zirconia. In such a case, from the perspective of achieving together at a high level the suppression of potential variation and the stability of the coating liquid for an intermediate layer, the molar ratio (Zr/Ti) of zirconia to titanium is preferably 0.01 or more and 0.05 or less.

The acidic component of the rutile-type acidic titania sol according to the present invention may be an arbitrary acid, such as a mineral acid or an organic acid. However, from the perspective of suppressing potential variation, the rutile-type acidic titania sol according to the present invention is preferably a hydrochloric acid sol or a nitric acid sol.

The average primary particle diameter (average crystallite diameter) of the rutile-type titanium oxide crystal particles in the rutile-type acidic titania sol according to the present invention can be measured and calculated by the following method.

The half width β (radian) and peak position 2θ (radian) of the peak of the strongest interference line of titanium oxide are determined with an X-ray diffracting apparatus. The average primary particle diameter is calculated from the Scherrer's equation shown below. Average primary particle diameter (average crystallite diameter) of rutile-type titanium oxide crystal particles [nm]

$$=K\cdot\lambda/(\beta\cos\theta)$$

(In the above Scherrer's equation, K represents a constant, λ [nm] represents the wavelength of a measurement X-ray (CuK α-ray: 0.154 nm), β represents the half width, and θ represents the angle of incidence of the X-ray.)

The electrophotographic photosensitive member of the present invention can suppress the above-described short-term potential variation because the electrophotographic photosensitive member has an intermediate layer formed by applying a coating liquid for an intermediate layer, which contains an organic resin and a rutile-type acidic titania sol according to the present invention, and drying the applied liquid. Consequently, a change in the tint of an image within one sheet of paper can be suppressed. Further, when the same image is output on a plurality of sheets, the difference in image density between the first sheet and the n-th sheet (where n>1) can be suppressed. In addition, the above-described long-term potential variation can also be suppressed because deterioration in the potential characteristic of the electrophotographic photosensitive member when the electrophotographic photosensitive member is used for a long time period can be suppressed.

As described above, the electrophotographic photosensitive member of the present invention includes: a support, an intermediate layer formed on the support; a charge-generating layer containing a charge-generating substance, formed on the intermediate layer; and a hole-transporting layer containing a hole-transporting substance, formed on the charge-generating layer.

The support need only have conductivity (a conductive support). Examples of the support include a support made of a metal such as aluminum, stainless steel or nickel, and a support made of a metal, plastic or paper whose surface a conductive coating is formed on. In addition, the shape of the support is, for example, a cylindrical shape or a film shape. Of these, a cylindrical support made of aluminum is preferable in terms of mechanical strength, electrophotographic characteristics, and cost. While such supports may be used without being processed, they may be used after being subjected to physical process such as cutting or honing, or chemical process such as anodization treatment or acid treatment.

A conductive layer for the purpose of, for example, covering defects on the surface of the support or suppressing interference fringe (referred to also as "interference fringe-preventing layer") may be formed between the support and the intermediate layer.

Such a conductive layer can be formed by dispersing inorganic particles in a solvent together with a monomer or an oligomer of a curable resin to prepare a coating liquid for a conductive layer, applying the liquid onto the support, and drying the applied coating liquid.

Examples of the inorganic particles include particles of tin oxide, indium oxide, titanium oxide, and barium sulfate.

Examples of the curable resin include a phenol resin.

The conductive layer preferably has a thickness of 5 μm or more and 30 μm or less.

The intermediate layer is formed on the support or the conductive layer.

As described above, the intermediate layer is formed by applying the coating liquid for an intermediate layer, which contains an organic resin and the rutile-type acidic titania sol according to the present invention, onto the support or the conductive layer, and drying the applied coating liquid.

Examples of the organic resin (binder resin) used for the intermediate layer include a phenol resin, an epoxy resin, polyurethane, polycarbonate, polyarylate, polyester, polyimide, polyamide imide, polyamide acid, polyethylene, polystyrene, a styrene-acrylic copolymer, an acrylic resin, polymethacrylate, polyvinyl alcohol, polyvinyl acetal, polyvinyl butyral, polyvinyl benzal, polyvinyl formal, polyacrylonitrile, polyacrylamide, an acrylonitrile-butadiene copolymer, polyvinylchloride, a vinylchloride-vinyl acetate copolymer, cellulose, a melamine resin, amylose, amylopectin, polysulfone, polyether sulfone, polyamide (such as nylon 6, nylon 66, nylon 610, copolymer nylon, and alkoxymethylated nylons), and a silicone resin. These resins may be used each singly, or in a mixture of two or more of them. Of these resins, from the perspective of coating properties when applying a coating liquid for a charge-generating layer onto the intermediate layer, polyamides are preferred. Further, among polyamides, from the perspective of suppressing potential variation, alkoxymethylated nylons are preferable, and of those, N-methoxymethylated nylon 6 is more preferable.

Further, for the purpose of adjusting volume resistivity and dielectric constant, a metal or metal oxide may be included in the intermediate layer. Specific examples include particles of a metal such as aluminum and copper and particles of metal oxides such as aluminum oxide, tin oxide, indium oxide, titanium oxide, zirconium oxide, zinc oxide, silicon oxide, tantalum oxide, molybdenum oxide, and tungsten oxide. Further, the intermediate layer may also include organic metal compounds such as zirconium tetra-n-butoxide, titanium tetra-n-butoxide, aluminum isopropoxide and methylmethoxysilane, and carbon black. These may be used as a mixture. Among these, from the perspective of suppressing potential variation and suppressing injection of holes into the photosensitive layer, it is preferred to incorporate titanium oxide particles into the intermediate layer. In such a case, it is more preferred to incorporate titanium oxide particles having an average primary particle diameter of 13 nm or more and 60 nm or less. Moreover, from the perspective of suppressing a long-term potential variation, rutile-type titanium oxide crystal particles which have an average primary particle diameter of 13 nm or more and 60 nm or less and have not been surface treated are still more preferred. The expression "titanium oxide particles which have not been surface treated" refers to titanium oxide particles which have not been subjected to surface treatment (coating) with an inorganic material or an organic material.

If the average primary particle diameter is too small, the stability of the coating liquid for an intermediate layer deteriorates in some cases. If the average primary particle diameter is too large, the coating properties at the time of applying the coating liquid for a charge-generating layer onto the intermediate layer deteriorate in some cases.

Preferred examples of commercially available products of the titanium oxide particles which have an average primary particle diameter of 13 nm or more and 60 nm or less and have not been surface treated are shown below. However, the present invention is not limited to these examples.

Trade name: AMT-600 (manufactured by Tayca Corporation, anatase-type titanium oxide crystal particles having an average primary particle diameter of 30 nm)

Trade name: TKP-102 (manufactured by Tayca Corporation, anatase-type titanium oxide crystal particles having an average primary particle diameter of 15 nm)

Trade name: MT-150A (manufactured by Tayca Corporation, rutile-type titanium oxide crystal particles having an average primary particle diameter of 15 nm)

Trade name: MT-500B (manufactured by Tayca Corporation, rutile-type titanium oxide crystal particles having an average primary particle diameter of 35 nm)

Trade name: MT-600B (manufactured by Tayca Corporation, rutile-type titanium oxide crystal particles having an average primary particle diameter of 50 nm)

In addition, an azo pigment may be incorporated into the intermediate layer for suppressing a short-term potential variation. Examples of the azo pigment include a monoazo pigment, a disazo pigment, a trisazo pigment, and a tetrakisazo pigment. Although the azo pigment to be incorporated into the intermediate layer may be a pigment capable of being used as a charge-generating substance, if an azo pigment is incorporated into the intermediate layer as in the present invention, the azo pigment is not required to have substantial sensitivity.

Among azo pigments, an azo pigment including a coupler structure represented by the following general formula (1) is preferable, because such an azo pigment exhibits good dispersion stability in the coating liquid for an intermediate layer, which contains an organic resin and the rutile-type acidic titania sol according to the present invention, and because such an azo pigment improves the suppression of potential variation.

(1)

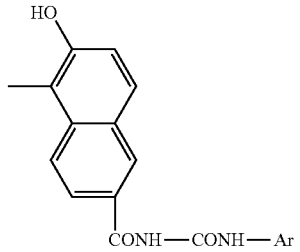

(In formula (1), Ar represents a substituted or unsubstituted aryl group.)

Of the azo pigments including a coupler structure represented by the above general formula (1), an azo pigment represented by the following general formula (2) is especially preferable in terms of having especially good dispersion stability in the coating liquid for an intermediate layer, which contains an organic resin and the rutile-type acidic titania sol according to the present invention, and in terms of suppressing potential variation.

(2)

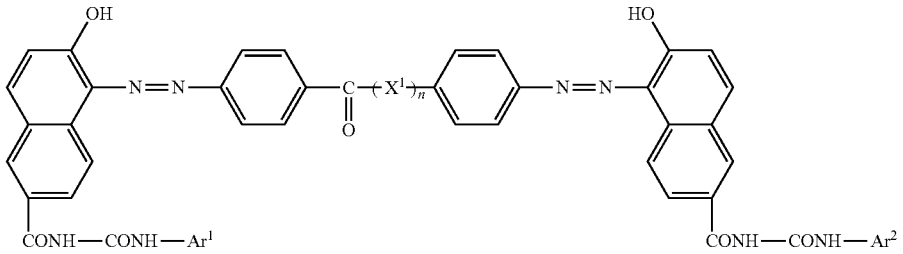

(In formula (2), $Ar_1$ and $Ar_2$ each independently represent a substituted or unsubstituted aryl group, $X^1$ represents a vinylene group or a p-phenylene group, and n denotes 0 or 1.)

In the above formulae (1) and (2), examples of the aryl group include a phenyl group and a naphthyl group. Examples of substituents the aryl group may have include an alkyl group, an aryl group, an alkoxy group, a dialkylamino group, an arylamino group, a halogen atom, a halomethyl group, a hydroxy group, a nitro group, a cyano group, an acetyl group, and a benzoyl group. Examples of the alkyl group include a methyl group, an ethyl group, a propyl group, and a butyl group. Examples of the aryl group include a phenyl group, a biphenyl group, and a naphthyl group. Examples of the alkoxy group include a methoxy group, a trifluoromethoxy group, and an ethoxy group. Examples of the dialkylamino group include a dimethylamino group and a diethylamino group. Examples of the arylamino group include a phenylamino group, and a diphenylamino group. Examples of the halogen atom include a fluorine atom, a chlorine atom, and a bromine atom. Examples of the halomethyl group include a trifluoromethyl group and a tribromomethyl group. Of these groups, a fluorine atom, a chlorine atom, a bromine atom, a trifluoromethyl group, a trifluoromethoxy group, and a nitro group are preferable.

Suitable examples of the azo pigment represented by the above general formula (2) are shown below. However, the present invention is not limited to these examples.

Example Compound (2-1)
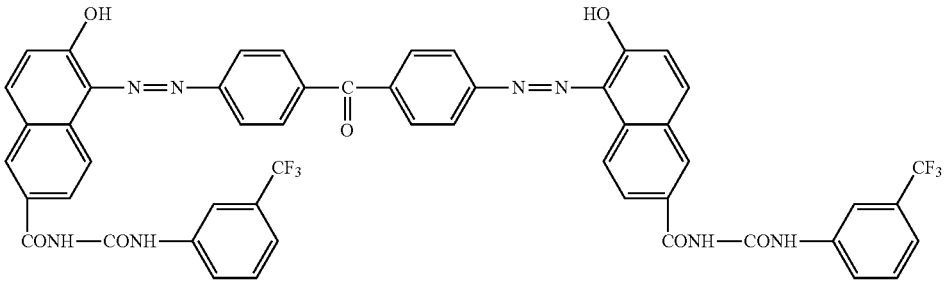
Example Compound (2-2)
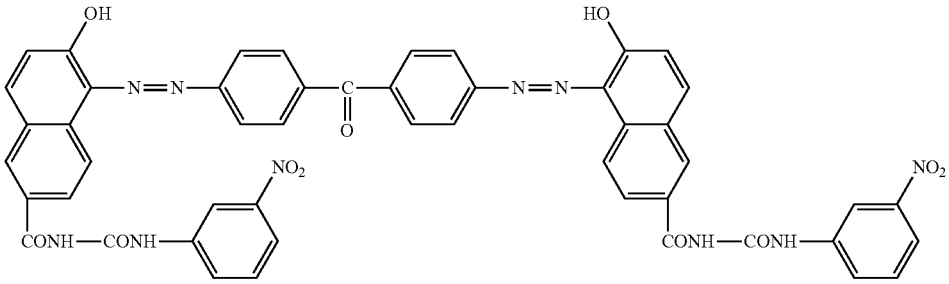
Example Compound (2-3)
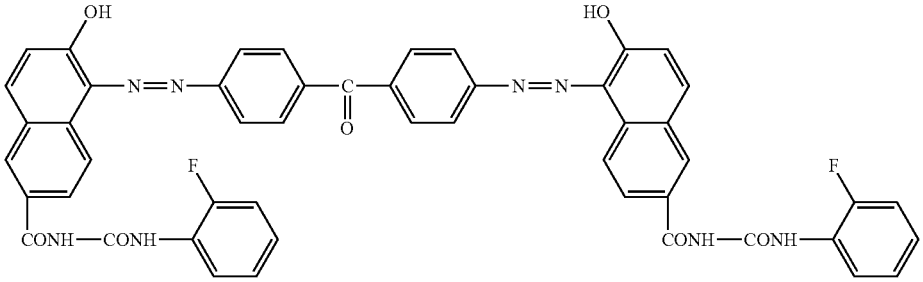
Example Compound (2-4)
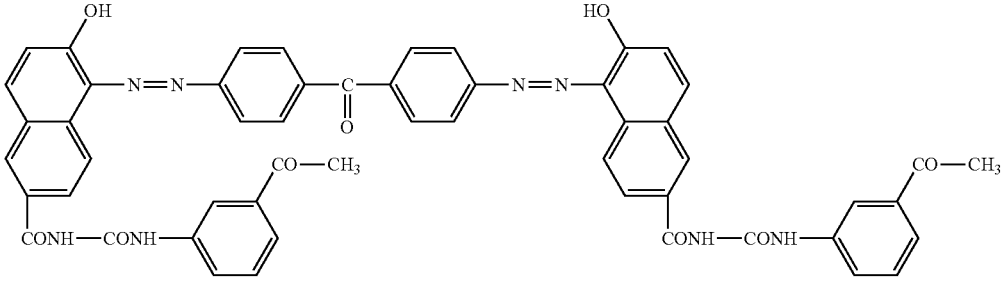

Example Compound (2-5)
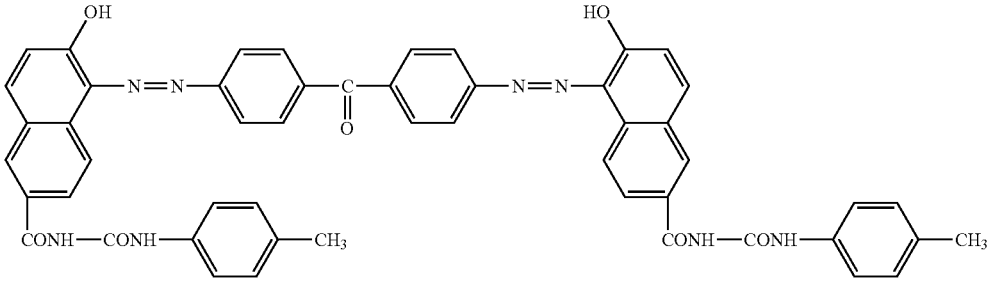
Example Compound (2-6)
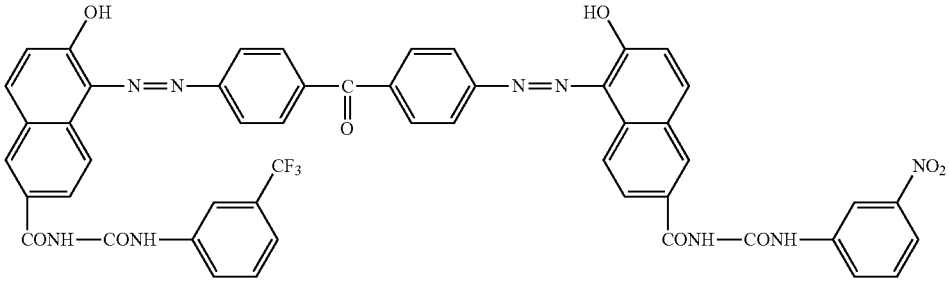
Example Compound (2-7)
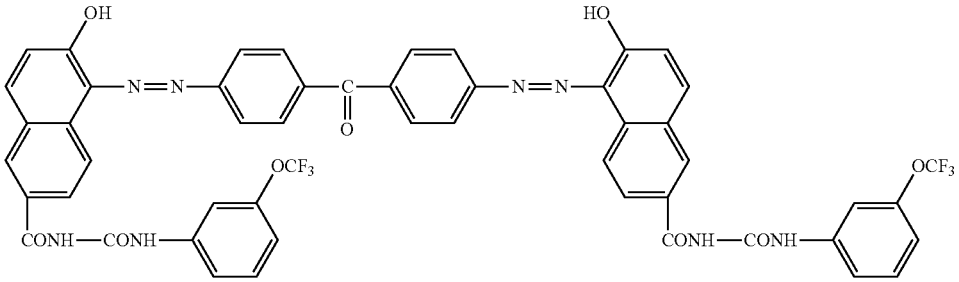
Example Compound (2-8)
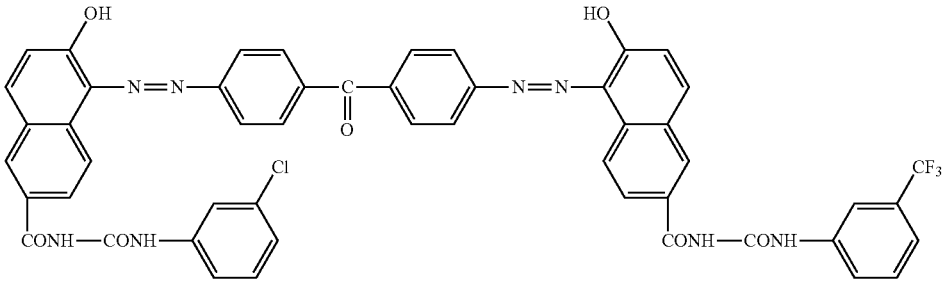

Example Compound (2-9)
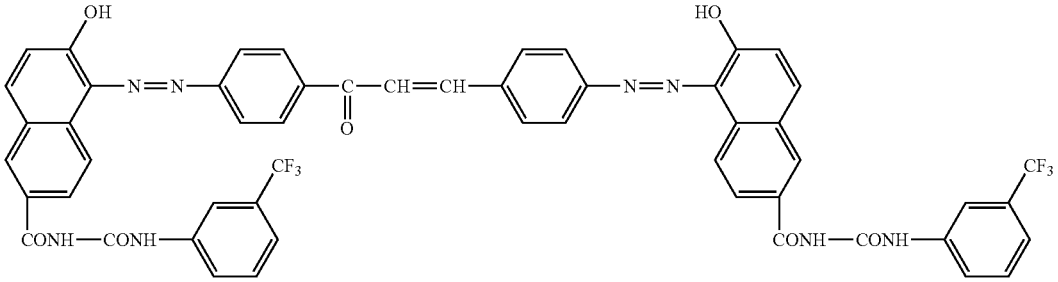
Example Compound (2-10)
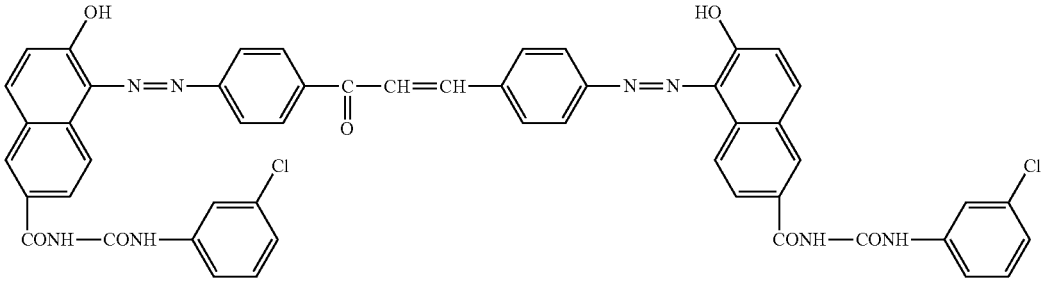
Example Compound (2-11)
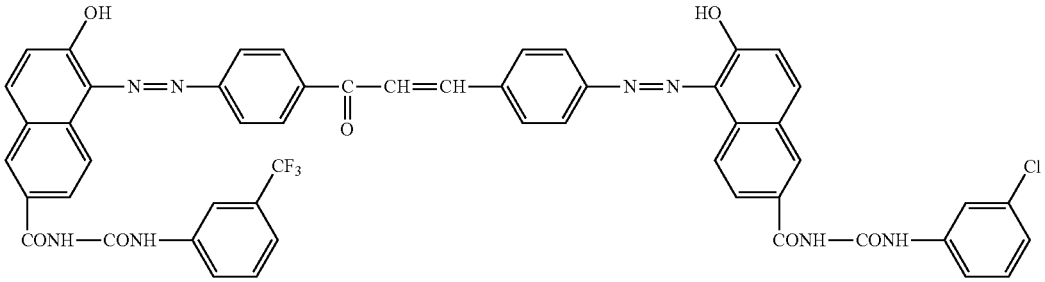
Example Compound (2-12)
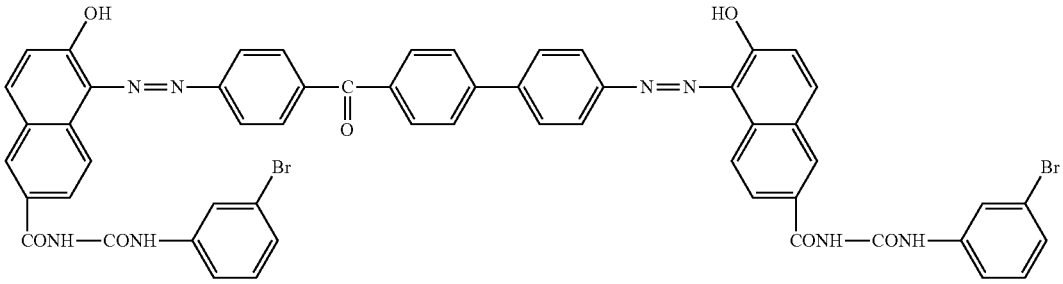

Example Compound (2-13)

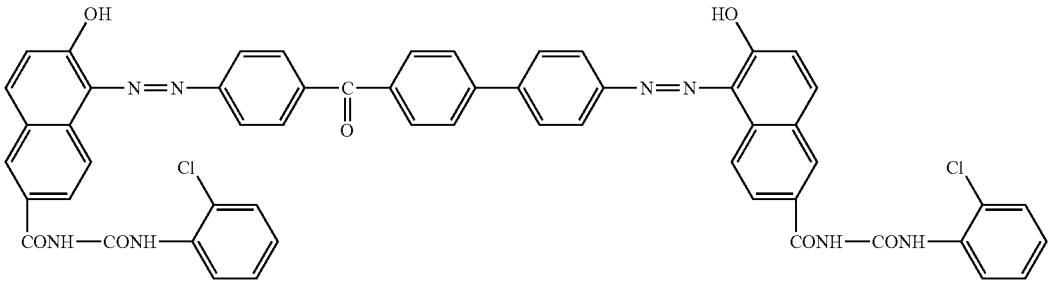

Example Compound (2-14)

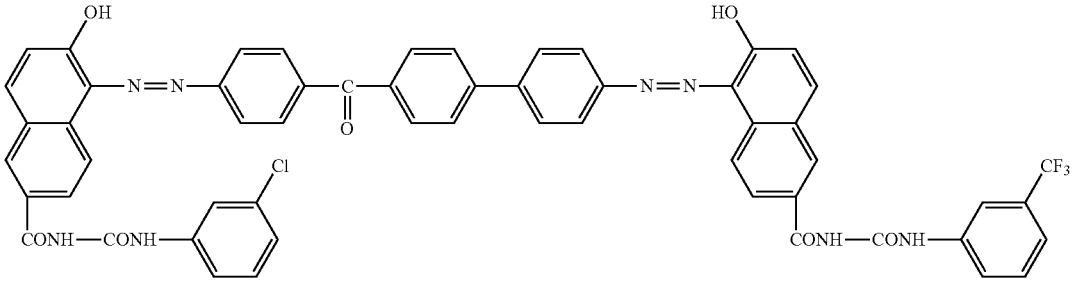

The azo pigment represented by the above general formula (2) can be synthesized on the basis of a general production method of an azo pigment as described in, for example, Japanese Patent Application Laid-Open No. H08-87124.

The content of the rutile-type titanium oxide crystal particles in the rutile-type acidic titania sol according to the present invention which is included in the coating liquid for an intermediate layer is preferably 0.5 mass % or more and 70 mass % or less, or more preferably 1.0 mass % or more and 10 mass % or less, based on the total mass of the dry solid content in the coating liquid for an intermediate layer. If the content of the rutile-type titanium oxide crystal particles is too large, the coating properties when applying the coating liquid for an intermediate layer deteriorate in some cases, and the stability of the coating liquid for an intermediate layer deteriorates in some cases. If the content is too low, the effects of the present invention are reduced in some cases.

When titanium oxide particles having an average primary particle diameter of 13 nm or more and 60 nm or less are included in the intermediate layer, the content of the titanium oxide particles in the intermediate layer is preferably 20 mass % or more and 60 mass % or less, or more preferably 30 mass % or more and 50 mass % or less, based on the total mass of the intermediate layer. In addition, when an azo pigment is included in the intermediate layer, the content of the azo pigment in the intermediate layer is preferably 5 mass % or more and 30 mass % or less, or more preferably 15 mass % or more and 25 mass % or less, based on the total mass of the intermediate layer.

The coating liquid for an intermediate layer containing an organic resin and the rutile-type acidic titania sol according to the present invention can be prepared by dissolving or dispersing an organic resin and the rutile-type acidic titania sol according to the present invention in a solvent.

Examples of the solvents used for the coating liquid for an intermediate layer include methylal, tetrahydrofuran, methanol, ethanol, isopropyl alcohol, butyl alcohol, methyl cellosolve, and methoxy propanol. One of these solvents may be used each singly, or in a mixture of two or more of them. From the perspective of the coating properties when applying the coating liquid for an intermediate layer, it is preferred to use two or more of these solvents as a mixture. When N-methoxymethylated nylon 6 is used as the organic resin, a mixed solvent of methanol and butanol, or a mixed solvent of ethanol and butanol is preferable in terms of the stability of the coating liquid for an intermediate layer and the coating properties when applying the coating liquid for an intermediate layer.

Examples of a drying method for drying the coating liquid for an intermediate layer after the application of the liquid include drying by heating or by blowing. The drying temperature is preferably 50° C. or higher and 160° C. or lower, or more preferably 140° C. or higher and 155° C. or lower, from the perspective of the coating properties when applying the coating liquid for a charge-generating layer onto the intermediate layer and the suppression of potential variation.

The intermediate layer has a thickness of preferably 0.1 μm or more and 5.0 μm or less, more preferably 0.3 μm or more and 1.5 μm or less, or still more preferably 0.5 μm or more and 1.0 μm or less, from the perspective of suppressing potential variation and suppressing injection of holes into the photosensitive layer.

The charge-generating layer containing the charge-generating substance is formed on the intermediate layer.

The charge-generating layer can be formed by dissolving or dispersing the charge-generating substance in a solvent together with a binder resin to prepare the coating liquid for a charge-generating layer, applying the liquid onto the intermediate layer, and drying the applied coating liquid.

Examples of the solvent used in the coating liquid for a charge-generating layer include ethers, ketones, esters, and aromatic compounds. Examples of the ethers include tetrahydrofuran and 1,4-dioxane. Examples of the ketones include cyclohexanone, 4-methoxy-4-methyl-2-pentanone, and methylethylketone. Examples of the esters include ethyl acetate and butyl acetate. Examples of the aromatic compounds include toluene, xylene, and monochlorobenzene.

Examples of the binder resin used in the charge-generating layer include a phenol resin, an epoxy resin, polyurethane, polycarbonate, polyarylate, polyester, polyimide, polyamide imide, polyamide acid, polyethylene, polystyrene, a styrene-acrylic copolymer, an acrylic resin, polymethacrylate, polyvinyl alcohol, polyvinyl acetal, polyvinyl butyral, polyvinyl benzal, polyvinyl formal, polyacrylonitrile, polyacrylamide, an acrylonitrile-butadiene copolymer, polyvinylchloride, a vinylchloride-vinyl acetate copolymer, cellulose, a melamine resin, amylose, amylopectin, polysulfone, polyether sulfone, and a silicone resin.

Examples of the charge-generating substance include azo pigments and phthalocyanine pigments. Examples of the azo pigments include a monoazo pigment, a bisazo pigment, a trisazo pigment, and a tetrakisazo pigment.

Of the azo pigments, a benzanthrone-type azo pigment disclosed in Japanese Patent Application Laid-Open No. 559-31962 or Japanese Patent Application Laid-Open No. H1-183663 is preferable, because the pigment has excellent sensitivity. Although the benzanthrone-type azo pigment has excellent sensitivity, the pigment tends to cause potential variation. However, the incorporation of the benzanthrone-type azo pigment as a charge-generating substance into the charge-generating layer formed on the above intermediate layer can suppress potential variation while maintaining the excellent sensitivity. Accordingly, the benzanthrone-type azo pigment allows the effects of the present invention to be more effectively exhibited, and can be said to be preferable.

Further, examples of the phthalocyanine pigments include non-metallic phthalocyanine and metallic phthalocyanine. The metallic phthalocyanine may include an axial ligand. Further, the phthalocyanine may be substituted.

Of the phthalocyanine pigments, oxytitanium phthalocyanine and gallium phthalocyanine (such as chlorogallium phthalocyanine and hydroxygallium phthalocyanine) are preferable due to their excellent sensitivity. Although oxytitanium phthalocyanine and gallium phthalocyanine have excellent sensitivity, they are liable to cause potential variation. However, when oxytitanium phthalocyanine or gallium phthalocyanine is incorporated as a charge-generating substance into the charge-generating layer formed on the above intermediate layer, potential variation can be suppressed while maintaining the excellent sensitivity. Accordingly, oxytitanium phthalocyanine or gallium phthalocyanine allow the effects of the present invention to be more effectively exhibited, and can be said to be preferable.

In addition, a hydroxygallium phthalocyanine crystal in a crystal form having strong peaks at $2\theta \pm 0.2°$ (where $\theta$ represents a Bragg angle in CuK $\alpha$ X-ray diffraction) of $7.4° \pm 0.3°$ and $28.2° \pm 0.3°$ among gallium phthalocyanines is more preferable. Although this hydroxygallium phthalocyanine crystal has particularly excellent sensitivity, the crystal tends to cause potential variation (especially, a variation in initial light potential when image formation is performed in a low-humidity environment). However, when such a hydroxygallium phthalocyanine crystal is incorporated as a charge-generating substance into the charge-generating layer formed on the above intermediate layer, potential variation can be suppressed while maintaining the particularly excellent sensitivity. Accordingly, the hydroxygallium phthalocyanine crystal allows the effects of the present invention to be more effectively exhibited, and can be said to be particularly preferable.

X-ray diffraction measurement in the present invention was performed with CuK $\alpha$-rays under the following conditions.

Measurement machine used: An automatic X-ray diffraction apparatus MXP18 manufactured by MAC Science
X-ray tube: Cu
Tube voltage: 50 kV
Tube current: 300 mA
Scanning method: $2\theta/\theta$ scan
Scanning rate: 2 deg./min
Sampling interval: 0.020 deg.
Start angle ($2\theta$): 5 deg.
Stop angle ($2\theta$): 40 deg.
Divergence slit: 0.5 deg.
Scattering slit: 0.5 deg.
Receiving slit: 0.3 deg.

A curved monochromator was used.

The charge-generating layer has a thickness of preferably 0.01 μm or more and 10 μm or less, or more preferably 0.05 μm or more and 5 μm or less.

The hole-transporting layer containing the hole-transporting substance is formed on the charge-generating layer.

The hole-transporting layer can be formed by dissolving the hole-transporting substance in a solvent together with a binder resin to prepare a coating liquid for a hole-transporting layer, applying the liquid onto the charge-generating layer, and drying the applied coating liquid.

Examples of the solvent used as the coating liquid for a hole-transporting layer include ethers, ketones, esters, and aromatic compounds. Examples of the ethers include tetrahydrofuran and 1,4-dioxane. Examples of the ketones include cyclohexanone, 4-methoxy-4-methyl-2-pentanone, and methylethylketone. Examples of the esters include ethyl acetate and butyl acetate. Examples of the aromatic compounds include toluene, xylene, and monochlorobenzene.

Examples of the binder resin used in the hole-transporting layer include a phenol resin, an epoxy resin, polyurethane, polycarbonate, polyarylate, polyester, polyimide, polyamide imide, polyamide acid, polyethylene, polystyrene, a styrene-acrylic copolymer, an acrylic resin, polymethacrylate, polyvinyl alcohol, polyvinyl acetal, polyvinyl butyral, polyvinyl benzal, polyvinyl formal, polyacrylonitrile, polyacrylamide, an acrylonitrile-butadiene copolymer, polyvinylchloride, a vinylchloride-vinyl acetate copolymer, cellulose, a melamine resin, amylose, amylopectin, polysulfone, polyether sulfone, and a silicone resin.

Examples of the hole-transporting material include triarylamine-type compounds, hydrazone-type compounds, stilbene-type compounds, pyrazoline-type compounds, oxazole-type compounds, triazole-type compounds, triallylmethane-type compounds, enamine-type compounds, and butadiene-type compounds.

The hole-transporting layer has a thickness of preferably 5 μm or more and 40 μm or less, or more preferably 10 μm or more and 30 μm or less.

In addition, a protective layer may be provided on the hole-transporting layer for the purpose of improving, for example, durability, transferability, and cleaning properties.

The protective layer can be formed by dissolving a resin in a solvent to prepare a coating liquid for a protective layer, applying the liquid onto the hole-transporting layer, and drying the applied coating liquid.

Examples of the resin include polyvinyl butyral, polyester, polycarbonate, polyamide, polyimide, polyarylate, polyurethane, a styrene-butadiene copolymer, a styrene-acrylic acid copolymer, and a styrene-acrylonitrile copolymer.

Alternatively, in order to impart a charge-transporting ability (hole-transporting ability) to the protective layer, the protective layer may be formed by curing a monomer having a charge-transporting ability (hole-transporting ability) or a polymeric charge-transporting substance (hole-transporting substance) by using various crosslinking reactions. Examples of the curing reactions include radical polymerization, ion polymerization, thermal polymerization, photopolymerization, radiation polymerization (electron beam polymerization), a plasma CVD method, and a photo CVD method.

Further, the protective layer may also include conductive particles, a UV absorber, a wear resistance improver and the like. Examples of the conductive particles include particles of a metal oxide such as tin oxide. In addition, examples of the wear resistance improver include fluorine atom-containing resin particles, alumina, silica and the like.

The protective layer has a thickness of preferably 0.5 μm or more and 20 μm or less, or more preferably 1 μm or more and 10 μm or less.

Examples of a method for applying the coating liquid for each of these layers include a dip coating method (dipping method), a spray coating method, a spinner coating method, a bead coating method, a blade coating method, and a beam coating method.

Next, an electrophotographic apparatus having the electrophotographic photosensitive member of the present invention will be described.

The electrophotographic apparatus of the present invention includes: the above electrophotographic photosensitive member of the present invention; a charging unit for charging the surface of the electrophotographic photosensitive member; an exposure unit for irradiating the charged surface of the electrophotographic photosensitive member with exposure light to form an electrostatic latent image on the surface of the electrophotographic photosensitive member; a developing unit for developing the electrostatic latent image formed on the surface of the electrophotographic photosensitive member with toner to form a toner image on the surface of the electrophotographic photosensitive member; and a transferring unit for transferring the toner image formed on the surface of the electrophotographic photosensitive member onto a transfer material.

FIG. 1 is a schematic structural diagram of an electrophotographic apparatus including a process cartridge having the electrophotographic photosensitive member of the present invention.

In FIG. 1, a drum-shaped electrophotographic photosensitive member 1 according to the present invention is rotated around an axis 2 in the direction indicated by an arrow at a predetermined cycle time (time taken for one rotation). During the course of the rotation, the surface of the electrophotographic photosensitive member 1 is charged to a predetermined, positive or negative potential by a charging unit 3. Next, the charged surface receives exposure light 4 emitted from an exposure unit (not shown) such as slit exposure or laser beam scanning exposure. The intensity of the exposure light 4 is modulated in accordance with a time series electrical digital image signal of information on a target image. Accordingly, an electrostatic latent image corresponding to the target image information is formed on the surface of the electrophotographic photosensitive member 1.

The electrostatic latent image formed on the surface of the electrophotographic photosensitive member 1 is developed (subjected to normal development or reverse development) with toner stored in a developing unit 5, whereby a toner image is formed. The toner image formed on the surface of the electrophotographic photosensitive member 1 is transferred onto a transfer material 7 (such as paper) by a transferring unit 6. If the transfer material 7 is paper, for example, the transfer material is taken out of a paper feeding part (not shown) and is fed into a space between the electrophotographic photosensitive member 1 and the transferring unit 6 in synchronization with the rotation of the electrophotographic photosensitive member 1. In this case, a voltage of a polarity opposite to the charge of the toner is applied from a power supply (not shown) to the transferring unit 6.

The transfer material 7 onto which the toner image has been transferred is separated from the surface of the electrophotographic photosensitive member 1 and is conveyed to a fixing unit 8 where the toner image is subjected to fixing treatment. Consequently, the transfer material is discharged (printed out) as an image formed matter (a print or a copy) out of the electrophotographic apparatus.

A deposit, such as toner remaining on the surface of the electrophotographic photosensitive member 1 after the transfer of the toner image onto the transfer material 7 (transfer residual toner), is removed by a cleaning unit 9, whereby the surface of the electrophotographic photosensitive member 1 is cleaned.

Recent research on a cleaner-less system has enabled the transfer residual toner to be directly collected by, for example, the developing unit.

The surface of the electrophotographic photosensitive member 1 is repeatedly used in image formation after having been de-charged by pre-exposure light 10 from a pre-exposure unit (not shown). Pre-exposure is not necessarily needed when the charging unit 3 is a contact charging unit using a charging roller or the like.

In the present invention, for example, the electrophotographic photosensitive member 1 may be held integrally with at least one unit selected from the group consisting of the charging unit 3, the developing unit 5 and the cleaning unit 9, to form a process cartridge 11 which is detachably mountable on the main body of the electrophotographic apparatus with the aid of a guiding unit 12 (such as a rail) of the main body.

In addition, the exposure light 4 may be reflected light or transmitted light from an original when the electrophotographic apparatus is a copying machine or a printer. Alternatively, the exposure light may be light applied according to, for example, scanning with a laser beam performed in compliance with a signal into which an original read by a sensor has been converted, driving of an LED array, or driving of a liquid crystal shutter array.

Laser light having an oscillation wavelength of 380 to 450 nm may also be preferably used as the exposure light, because the electrophotographic photosensitive member of the present invention is allowed to keep potential variation at the time of image formation extremely small. The use of an exposure unit using such short-wavelength laser together with the above electrophotographic photosensitive member of the present invention enables high-resolution images to be stably formed over a long time period.

In addition, there is a tendency that the higher the process speed of an electrophotographic process and the smaller the diameter of the electrophotographic photosensitive member, the smaller the cycle time (time taken one rotation) of the electrophotographic photosensitive member is and the larger the short-term potential variation in the electrophotographic photosensitive member is. However, the electrophotographic photosensitive member of the present invention can suppress potential variation in the electrophotographic photosensitive member even in such cases. In particular, an electrophotographic apparatus having a cycle time of 0.4 sec or less/rotation is under severe conditions regarding potential variation in an electrophotographic photosensitive member. However, according to the present invention, even for such an electrophotographic apparatus, potential variation in an electrophotographic photosensitive member can be sufficiently suppressed.

The electrophotographic photosensitive member of the present invention can not only be utilized in a copying machine or laser beam printer, but also be widely applied in electrophotography fields such as a CRT printer, an LED printer, a FAX machine, a liquid crystal printer, and laser plate making.

Hereinafter, the present invention is described in more detail by way of specific examples. However, the present invention is not limited to these examples. In the examples, "%" and "part(s)" refer to "mass %" and "part(s) by mass", respectively. Further, the thickness of each layer of the electrophotographic photosensitive member was determined with an eddy-current thickness meter (Fischerscope, manufactured by Fischer Instruments K.K). or from the mass of the layer per unit area in terms of specific gravity.

Production Example 1

Production of the Rutile-Type Acidic Titania Sol According to the Present Invention A cake was obtained by processing based on the description in "Section 1, Production of rutile-form titanium oxide hydrosol" in Example 1 of Japanese Patent Application Laid-Open No. 2007-246351. Water and 36% hydrochloric acid were added to this cake, and were stirred. Consequently, an acidic titania sol (hydrochloric acid sol) containing zirconia and tin was obtained which had pH of 1.6, a titanium oxide crystal particle content of 15 mass %, a molar ratio of tin to titanium (Sn/Ti) of 0.053, and a molar ratio of zirconia to titanium (Zr/Ti) of 0.019. This acidic titania sol was dried at 100° C. to thereby obtain titanium oxide crystal particles. Based on X-ray diffraction, the obtained titanium oxide crystal particles were of a rutile type, and had an average primary particle diameter (average crystallite diameter) of 8 nm. Specifically, the acidic titania sol containing zirconia and tin obtained in Production Example 1 was a rutile-type acidic titania sol containing zirconia and tin. This acidic titania sol contained 15 mass % of rutile-type titanium oxide crystal particles having an average primary particle diameter of 8 nm.

Production Example 2

Production of the Rutile-Type Acidic Titania Sol According to the Present Invention 40 g of an aqueous solution of sodium silicate in which the content of silicon oxide was 10% (of which silicon oxide was 4 g) and 2 g of a 48% sodium hydroxide aqueous solution were placed in a glass beaker, and were diluted with ion-exchange water to prepare a solution of 1,200 g in total. To this solution, a solution of 1,000 g in total prepared by diluting 267 g of the rutile-type acidic titania sol containing zirconia and tin obtained in Production Example 1 (of which titanium oxide was 40 g) with ion-exchange water was slowly dropwise added under stirring. Next, the solution was heated to 80° C., and then adjusted to pH of 8 with a hydrochloric acid aqueous solution. The solution was aged for 2 hours at the same temperature. The solution was cooled to room temperature, then adjusted to pH of 3 by adding a citric acid aqueous solution. This solution was subjected to ultrafiltration overnight while supplementing ion-exchange water of the same amount as the filtration amount in an ultrafiltration module, to reduce the amount of the electrolytic component. Subsequently, the solution was concentrated. Consequently, an acidic titania sol containing zirconia and tin was obtained in which the pH was 5.6 and the content of silica-surface-coated titanium oxide crystal particles was 15 mass %. This acidic titania sol was dried at 100° C. to thereby obtain titanium oxide crystal particles. Based on X-ray diffraction, the obtained titanium oxide crystal particles were of a rutile-type, and had an average primary particle diameter (average crystallite diameter) of 8 nm. Further, the dry solid content was 20 mass %. Specifically, the acidic titania sol containing zirconia and tin obtained in Production Example 2 was a rutile-type acidic titania sol containing zirconia and tin. This acidic titania sol contained 15 mass % of rutile-type titanium oxide crystal particles which were surface-coated with silica and had an average primary particle diameter of 8 nm.

Example 1

An aluminum cylinder which was formed from a drawn tube and had a diameter of 30 mm was used as a support.

Preparation of Coating Liquid for Conductive Layer 50 parts of titanium oxide particles surface-coated with tin oxide (trade name: Kronos ECT-62, manufactured by Titan Kogyo, Ltd.), 41.7 parts of a resol-type phenol resin (trade name: Plyophen J-325, manufactured by DIC Corporation, resin solid content: 60%), 20 parts of 1-methoxy-2-propanol, 3.8 parts of spherical silicone resin particles (trade name: Tospearl 120, manufactured by Toshiba Silicones), 5 parts of methanol, and 0.002 parts of silicone oil (polydimethylsiloxane-polyoxyalkylene copolymer, average molecular weight: 3,000) were placed into a sand mill apparatus using 125 parts of glass beads having an average diameter of 0.8 mm, and were subjected to dispersion treatment at 2,000 rpm for 3 hours.

After the dispersion treatment, the glass beads were separated by mesh filtration. Then, the separated liquid was diluted with a mixed solvent of 1-methoxy-2-propanol and methanol in a ratio of 1:1 so that a solid content was 55%, whereby a coating liquid for a conductive layer was prepared.

Formation of Conductive Layer (Conductive Layer-Forming Step)

The above coating liquid for a conductive layer was applied onto the above support by dip coating, and was dried for 30 minutes at 140° C., whereby a conductive layer having a thickness of 15 μm was formed.

A sand mill apparatus satisfying the following conditions was used in the preparation of the coating liquid for a conductive layer, and in the below-described preparation of a coating liquid for an intermediate layer and the preparation of a coating liquid for a charge-generating layer.

Batch-type vertical apparatus 900 ml-scale vessel volume
Number of disks: Five
Cooling water temperature: 18° C.

Preparation of Coating Liquid for Intermediate Layer 25 parts of N-methoxymethylated nylon 6 (trade name: Toresin EF-30T, manufactured by Nagase ChemteX Corporation, methoxymethylation ratio: 36.8%) was dissolved in 225 parts of n-butanol (dissolution by heating at 50° C.). After dissolution, the solution was cooled and filtrated with a membrane filter (trade name: FP-022, pore size: 0.22 μm, manufactured by Sumitomo Electric Industries, Ltd.). Next, 5.5 parts of the rutile-type acidic titania sol containing zirconia and tin obtained in Production Example 1 was added to the filtrate, and was placed into a sand mill apparatus using 500 parts of glass beads having an average diameter of 0.8 mm, and was subjected to dispersion treatment at 800 rpm for 30 minutes.

After the dispersion treatment, the glass beads were separated by mesh filtration. Then, the separated liquid was diluted with methanol and n-butanol so that the solid content was 3.0% and the solvent ratio of methanol to n-butanol was 2:1, whereby a coating liquid for an intermediate layer was prepared.

The content of the rutile-type titanium oxide crystal particles in the rutile-type acidic titania sol containing zirconia and tin in the coating liquid for an intermediate layer was 3.2 mass % based on the total mass of the dry solid matter in the coating liquid for an intermediate layer.

Formation of Intermediate Layer (Intermediate Layer-Forming Step)

The above coating liquid for an intermediate layer was applied onto the above conductive layer by dip coating, and was dried for 10 minutes at 100° C., whereby an intermediate layer having a thickness of 0.45 μm was formed.

Preparation of Coating Liquid for Charge-Generating Layer 21 parts of a hydroxygallium phthalocyanine crystal (charge-generating substance) in a crystal form having a strong peaks at 2θ±0.2° (where θ represents a Bragg angle in CuK α X-ray diffraction) of 7.5° and 28.3°, and polyvinyl butyral (trade name: S-LEC BX-1, manufactured by Sekisui Chemical Co., Ltd.) were dissolved in cyclohexanone, whereby a resin solution having a resin concentration of 5% was obtained. 210 parts of this resin solution was placed into a sand mill apparatus using 500 parts of glass beads having an average diameter of 0.8 mm, and was subjected to dispersion treatment at 1,500 rpm for 4 hours.

After the dispersion treatment, the resultant product was diluted with 350 parts of cyclohexanone and 600 parts of ethyl acetate. The glass beads were separated by mesh filtration, whereby a coating liquid for a charge-generating layer was prepared.

Formation of Charge-Generating Layer (Charge-Generating Layer-Forming Step)

The above coating liquid for a charge-generating layer was applied onto the above intermediate layer by dip coating, and was dried for 10 minutes at 100° C., whereby a charge-generating layer having a thickness of 0.17 μm was formed.

Preparation of Coating Liquid for Hole-Transporting Layer 5 parts of a compound (hole-transporting substance) represented by the following structural formula (CTM-1), (CTM-1)

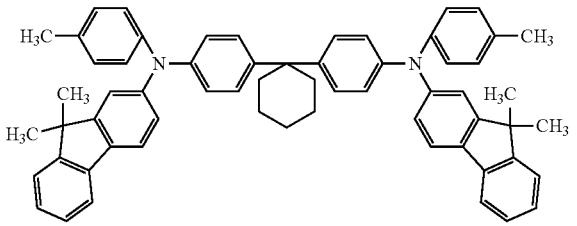

5 parts of a compound (hole-transporting substance) represented by the following structural formula (CTM-2), (CTM-2)

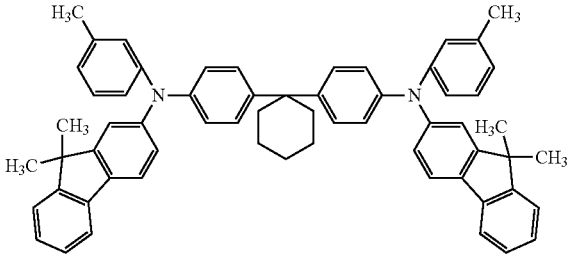

and 10 parts of polycarbonate (trade name: Iupilon Z-400, manufactured by Mitsubishi Engineering-Plastics Corporation) were dissolved in 70 parts of monochlorobenzene, whereby a coating liquid for a hole-transporting layer was prepared.

Formation of Hole-Transporting Layer (Hole-Transporting Layer-Forming Step)

The above coating liquid for a hole-transporting layer was applied onto the above charge-generating layer by dip coating. The coating liquid applied was dried for 30 minutes at 100° C., whereby a hole-transporting layer having a thickness of 18 μm was formed.

Preparation of Coating Liquid for Protective Layer 36 parts of a compound (hole-transporting substance) represented by the following structural formula (CTM-3), (CTM-3)

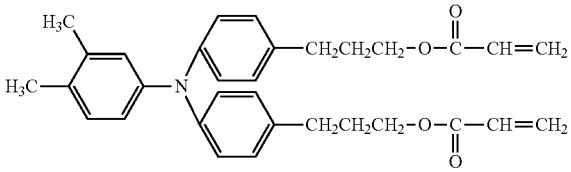

4 parts of polytetrafluoroethylene particles (trade name: LUBRON L-2, manufactured by Daikin Industries, Ltd.), and 60 parts of n-propyl alcohol were mixed. The resultant mixture was subjected to dispersion treatment with an ultra-high pressure dispersing machine, whereby a coating liquid for a protective layer was prepared.

Formation of Protective Layer (Protective Layer-Forming Step)

The above coating liquid for a protective layer was applied onto the above hole-transporting layer by dip coating, and was dried to the touch. After that, in a nitrogen atmosphere, the resultant product was irradiated with an electron beam at an accelerating voltage of 60 kV and a dose of 0.8 Mrad. Subsequently, the irradiated body was subjected to heat treatment for 1 minute so that the temperature of the irradiated body was 150° C. In this case, the oxygen concentration in the nitrogen atmosphere was 20 ppm. Further, the resultant product was subjected to heat treatment in air at 120° C. for 1 hour, whereby a protective layer having a thickness of 5 μm was formed.

Thus, the electrophotographic photosensitive member 1 was obtained.

Next, the produced electrophotographic photosensitive member 1 was mounted on a modified copying machine GP-40 (trade name) manufactured by Canon Inc. (the light source was changed to a 778 nm semiconductor laser with a variable light quantity, pre-exposure was changed to a red LED with a variable light quantity, and the motor was changed to a motor with a variable process speed), and was evaluated for a potential characteristic when repeatedly used.

The potential of the electrophotographic photosensitive member was measured by removing the developing unit from the main body of the above copying machine, and fixing a probe for potential measurement at the developing position instead of the developing unit. The transfer unit was arranged so as to be in non-contact with the electrophotographic photosensitive member, and no paper was passed.

First, the electrophotographic photosensitive member 1 was left to stand in a normal-temperature, low-humidity (23° C./5% RH) environment for 3 days together with the above copying machine. After that, in the same environment, a charging condition and the light quantity of exposure (image exposure) were set so that a dark potential (Vd) was −700 V and a light potential (Vl) was −200 V. In addition, the light quantity of pre-exposure was three times as large as the light quantity of the LED for attenuating the dark potential from −700 V to −200 V. In addition, the process speed was adjusted to 320 mm/sec (cycle speed was adjusted to 0.29 sec/rotation).

Next, a Vl durability test involving 5,000 continuous rotations (durability test according to a full-screen black image mode) was performed, and the light potential (Vl) after the 5,000 rotations was measured. As a result, the light potential was Vl=−202 V. In this case, the difference (variation) between the initial light potential (Vl) and the light potential (Vl) after the Vl durability test involving 5,000 rotations is defined as ΔVl (initial)=+2 V.

After that, a Vl durability test involving 500,000 rotations was performed. 5 minutes after the completion of the test, the difference (variation, referred to as "ΔVl (after 5 minutes)") between the initial light potential (Vl) and the light potential (Vl) after a Vl durability test involving 5,000 rotations was measured. As a result, ΔVl (after 5 minutes) was +13 V.

The next day (after 24 hours), the difference (variation, referred to as "ΔVl (next day)") between the initial light potential (Vl) and the light potential (Vl) after a Vl durability test involving 5,000 rotations was similarly measured. As a result, ΔVl (next day) was +12 V.

Additionally, after one week, the difference (variation, referred to as "ΔVl (after one week)") between the initial light potential (Vl) and the light potential (Vl) after a Vl durability test involving 5,000 rotations was similarly measured. As a result, ΔVl (after one week) was +10 V.

In addition, the difference (variation, referred to as "ΔVl (long-term variation)") between the above initial light potential (Vl) after one week and the initial light potential (Vl) before a Vl durability test, which was considered to be a long-term potential variation due to insufficient recoverability, was as follows: ΔVl (long-term variation)=+15 V.

All the foregoing series of evaluations was performed in a normal-temperature, very-low-humidity environment, without changing the charging condition, the light quantity of the exposure (image exposure) and the pre-exposure, and the process speed from the initial setting. In addition, the pre-exposure was turned on even during the Vl durability test.

The evaluation results are shown in Table 1.

Comparative Example 1

An electrophotographic photosensitive member C1 was produced in the same manner as in Example 1, except that the preparation of the coating liquid for an intermediate layer in Example 1 was performed as described below. In addition, the electrophotographic photosensitive member C1 was evaluated in the same manner as in Example 1. The evaluation results are shown in Table 1.

Preparation of Coating Liquid for Intermediate Layer 3 parts of N-methoxymethylated nylon 6 (trade name: Toresin EF-30T, manufactured by Nagase ChemteX Corporation, methoxymethylation ratio: 36.8%) was dissolved in a mixed solvent of 65 parts of methanol and 32.5 parts of n-butanol (dissolution by heating at 65° C.). After dissolution, the solution was cooled and filtrated with a membrane filter (trade name: FP-022, pore size: 0.22 manufactured by Sumitomo Electric Industries, Ltd.) to prepare a coating liquid for an intermediate layer.

Example 2

An electrophotographic photosensitive member 2 was produced in the same manner as in Example 1, except that the preparation of the coating liquid for an intermediate layer in Example 1 was performed as described below. In addition, the electrophotographic photosensitive member 2 was evaluated in the same manner as in Example 1. The evaluation results are shown in Table 1.

Preparation of Coating Liquid for Intermediate Layer 25 parts of N-methoxymethylated nylon 6 (trade name: Toresin EF-30T, manufactured by Nagase ChemteX Corporation, methoxymethylation ratio: 36.8%) was dissolved in 225 parts of n-butanol (dissolution by heating at 50° C.). After dissolution, the solution was cooled and filtrated with a membrane filter (trade name: FP-022, pore size: 0.22 μm, manufactured by Sumitomo Electric Industries, Ltd.). Next, 5.5 parts of the rutile-type acidic titania sol containing zirconia and tin obtained in Production Example 1 and 15 parts of rutile-type titanium oxide crystal particles (trade name: MT-150A, manufactured by Tayca Corporation) which had an average primary particle diameter of 15 nm and had not been surface treated were added to the filtrate. The mixture was placed into a sand mill apparatus using 500 parts of glass beads having an average diameter of 0.8 mm, and was subjected to dispersion treatment at 1,500 rpm for 7 hours.

After the dispersion treatment, the glass beads were separated by mesh filtration. Then, the separated liquid was diluted with methanol and n-butanol so that the solid content was 6.0% and the solvent ratio of methanol to n-butanol was 2:1 to prepare a coating liquid for an intermediate layer.

The content of the rutile-type titanium oxide crystal particles in the rutile-type acidic titania sol containing zirconia and tin in the coating liquid for an intermediate layer was 2.0 mass % based on the total mass of the dry solid matter in the coating liquid for an intermediate layer.

Comparative Example 2

An electrophotographic photosensitive member C2 was produced in the same manner as in Example 2, except that the rutile-type acidic titania sol containing zirconia and tin obtained in Production Example 1 was not added to the coating liquid for an intermediate layer. In addition, the electrophotographic photosensitive member C2 was evaluated in the same manner as in Example 1. The evaluation results are shown in Table 1.

Comparative Example 3

An electrophotographic photosensitive member C3 was produced in the same manner as in Comparative Example 2, except that the amount of the rutile-type titanium oxide crystal particles (trade name: MT-150A, manufactured by Tayca Corporation) which had an average primary particle diameter of 15 nm and had not been surface treated, used in the coating liquid for an intermediate layer in Comparative Example 2, was changed from 15 parts to 0.825 parts. In addition, the electrophotographic photosensitive member C3 was evaluated in the same manner as in Example 1. The evaluation results are shown in Table 1.

Comparative Example 4

An electrophotographic photosensitive member C4 was produced in the same manner as in Comparative Example 2, except that the rutile-type titanium oxide crystal particles (trade name: MT-150A, manufactured by Tayca Corporation), which had an average primary particle diameter of 15 nm and had not been surface treated, used in the coating liquid for an intermediate layer in Comparative Example 3, were changed to anatase-type titanium oxide crystal particles (trade name: AMT-100, manufactured by Tayca Corporation) which had an average primary particle diameter of 6 nm and had not been surface treated. In addition, the electrophotographic photosensitive member C4 was evaluated in the same manner as in Example 1. The evaluation results are shown in Table 1.

Example 3

An electrophotographic photosensitive member 3 was produced in the same manner as in Example 2, except that the rutile-type titanium oxide crystal particles (trade name: MT-150A, manufactured by Tayca Corporation) which had an average primary particle diameter of 15 nm, used in the coating liquid for an intermediate layer in Example 2, were changed to a sol containing 96 mass % of anatase-type titanium oxide crystal particles (trade name: TKP-102, manufactured by Tayca Corporation) which had an average primary particle diameter of 15 nm and had not been surface treated. In addition, the electrophotographic photosensitive member 3 was evaluated in the same manner as in Example 1. The evaluation results are shown in Table 1.

Example 4

An electrophotographic photosensitive member 4 was produced in the same manner as in Example 1, except that the amount of the rutile-type acidic titania sol containing zirconia and tin which was obtained in Production Example 1 and used in the coating liquid for an intermediate layer in Example 1 was changed from 5.5 parts to 15 parts. In addition, the electrophotographic photosensitive member 4 was evaluated in the same manner as in Example 1. The evaluation results are shown in Table 1.

Example 5

An electrophotographic photosensitive member 5 was produced in the same manner as in Example 1, except that the amount of the rutile-type acidic titania sol containing zirconia and tin which was obtained in Production Example 1 and used in the coating liquid for an intermediate layer in Example 1 was changed from 5.5 parts to 27.5 parts. In addition, the electrophotographic photosensitive member 5 was evaluated in the same manner as in Example 1. The evaluation results are shown in Table 1.

Example 6

An electrophotographic photosensitive member 6 was produced in the same manner as in Example 2, except that the rutile-type acidic titania sol containing zirconia and tin which was obtained in Production Example 1 and used in the coating liquid for an intermediate layer in Example 2 was changed to the rutile-type acidic titania sol containing zirconia and tin obtained in Production Example 2. In addition, the electrophotographic photosensitive member 6 was evaluated in the same manner as in Example 1. The evaluation results are shown in Table 1.

Example 7

An electrophotographic photosensitive member 7 was produced in the same manner as in Example 1, except that the drying performed after the dip coating with the coating liquid for an intermediate layer in Example 1 was changed from drying at 100° C. for 10 minutes to drying at 145° C. for 10 minutes. In addition, the electrophotographic photosensitive member 7 was evaluated in the same manner as in Example 1. The evaluation results are shown in Table 1.

Example 8

An electrophotographic photosensitive member 13 was produced in the same manner as in Example 1, except that the preparation of the coating liquid for an intermediate layer in Example 1 was performed as described below. In addition, the electrophotographic photosensitive member 8 was evaluated in the same manner as in Example 1. The evaluation results are shown in Table 1.

Preparation of Coating Liquid for Intermediate Layer 20 parts of N-methoxymethylated nylon 6 (trade name: Toresin EF-30T, manufactured by Nagase ChemteX Corporation, methoxymethylation ratio: 36.8%) was dissolved in 180 parts of n-butanol (dissolution by heating at 65° C.). After dissolution, the solution was cooled and filtrated with a membrane filter (trade name: FP-022, pore size: 0.22 μm, manufactured by Sumitomo Electric Industries, Ltd.). Next, the filtrate was left to stand for 5 days at room temperature in a hermetically sealed container to form a gelated polyamide resin solution.

Then, 3.4 parts of the rutile-type acidic titania sol containing zirconia and tin obtained in Production Example 1, 10.2 parts of rutile-type titanium oxide crystal particles (trade name: MT-150A, manufactured by Tayca Corporation) which had an average primary particle diameter of 15 nm and had not been surface treated, 5.3 parts of an azo pigment represented by the following structural formula (AZO-1), and 30 parts of ethanol were added to the above polyamide resin solution. The mixture was placed into a sand mill apparatus using 506 parts of glass beads having an average diameter of 0.8 mm, and was subjected to dispersion treatment at 1,500 rpm for 7 hours.

(AZO-1)

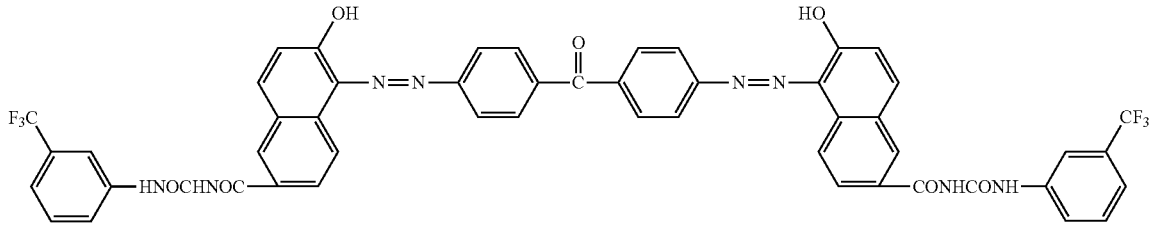

After the dispersion treatment, the glass beads were separated by mesh filtration. Then, the separated liquid was diluted with ethanol and n-butanol so that the solid content was 5.5% and the solvent ratio of ethanol to n-butanol was 2:1 to prepare a coating liquid for an intermediate layer.

The content of the rutile-type titanium oxide crystal particles in the rutile-type acidic titania sol containing zirconia and tin in the coating liquid for an intermediate layer was 1.4 mass % based on the total mass of the dry solid matter in the coating liquid for an intermediate layer.

Comparative Example 5

An electrophotographic photosensitive member C5 was produced in the same manner as in Example 8, except that the rutile-type acidic titania sol containing zirconia and tin obtained in Production Example 1 was not added to the coating liquid for an intermediate layer. In addition, the electrophotographic photosensitive member C5 was evaluated in the same manner as in Example 1. The evaluation results are shown in Table 1.

Comparative Example 6

An electrophotographic photosensitive member C4 was produced in the same manner as in Example 8, except that the rutile-type acidic titania sol containing zirconia and tin obtained in Production Example 1 and the rutile-type titanium oxide crystal particles (trade name: MT-150A, manufactured by Tayca Corporation) which had an average primary particle diameter of 15 nm and had not been surface treated, were not added to the coating liquid for an intermediate layer. In addition, the electrophotographic photosensitive member C4 was evaluated in the same manner as in Example 1. The evaluation results are shown in Table 1.

Example 9

An electrophotographic photosensitive member 9 was produced in the same manner as in Example 8, except that the amount of the rutile-type acidic titania sol containing zirconia and tin which was obtained in Production Example 1 and used in the coating liquid for an intermediate layer in Example 8 was changed from 3.4 parts to 6.8 parts. In addition, the electrophotographic photosensitive member 9 was evaluated in the same manner as in Example 1. The evaluation results are shown in Table 1.

Example 10

An electrophotographic photosensitive member 10 was produced in the same manner as in Example 8, except that the rutile-type titanium oxide crystal particles (trade name: MT-150A, manufactured by Tayca Corporation) which had an average primary particle diameter of 15 nm and had not been surface treated, used in the coating liquid for an intermediate layer in Example 8, were changed to rutile-type titanium oxide crystal particles (trade name: MT-500B, manufactured by Tayca Corporation) which had an average primary particle diameter of 35 nm and had not been surface treated. In addition, the electrophotographic photosensitive member 10 was evaluated in the same manner as in Example 1. The evaluation results are shown in Table 1.

Example 11

An electrophotographic photosensitive member 11 was produced in the same manner as in Example 8, except that the amount of the rutile-type titanium oxide crystal particles (trade name: MT-150A, manufactured by Tayca Corporation), which had an average primary particle diameter of 15 nm, used in the coating liquid for an intermediate layer in Example 8, was changed from 10.2 parts to 15.3 parts, and the amount of the rutile-type acidic titania sol containing zirconia and tin which was obtained in Production Example 1 and used in the coating liquid for an intermediate layer in Example 8, was changed from 3.4 parts to 5.1 parts. In addition, the electrophotographic photosensitive member 11 was evaluated in the same manner as in Example 1. The evaluation results are shown in Table 1.

Example 12

An electrophotographic photosensitive member 12 was produced in the same manner as in Example 8, except that the rutile-type acidic titania sol containing zirconia and tin which was obtained in Production Example 1 and used in the coating liquid for an intermediate layer in Example 8 was changed to the rutile-type acidic titania sol containing zirconia and tin obtained in Production Example 2. In addition, the electrophotographic photosensitive member 12 was evaluated in the same manner as in Example 1. The evaluation results are shown in Table 1.

Example 13

An electrophotographic photosensitive member 13 was produced in the same manner as in Example 1, except that the amount of the rutile-type acidic titania sol containing zirconia and tin which was obtained in Production Example 2 and used in the coating liquid for an intermediate layer in Example 1 was changed from 5.5 parts to 250 parts. In addition, the electrophotographic photosensitive member 13 was evaluated in the same manner as in Example 1. The evaluation results are shown in Table 1.

Example 14

An electrophotographic photosensitive member 14 was produced in the same manner as in Example 8, except that the thickness of the intermediate layer in Example 8 was changed from 0.45 μm to 0.65 μm. In addition, the electrophotographic photosensitive member 14 was evaluated in the same manner as in Example 1. The evaluation results are shown in Table 1.

TABLE 1

| | Electrophotographic photosensitive member | ΔV1 (Initial) | ΔV1 (After 5 minutes) | ΔV1 (Next day) | ΔV1 (After 1 week) | ΔV1 (Long-term variation) |
|---|---|---|---|---|---|---|
| Ex. 1 | Electrophotographic photosensitive member 1 | +2 | +13 | +12 | +10 | +15 |
| Ex. 2 | Electrophotographic photosensitive member 2 | +3 | +14 | +10 | +10 | +8 |
| Ex. 3 | Electrophotographic photosensitive member 3 | +4 | +15 | +15 | +12 | +10 |
| Ex. 4 | Electrophotographic photosensitive member 4 | +2 | +13 | +13 | +12 | +15 |
| Ex. 5 | Electrophotographic photosensitive member 5 | +4 | +15 | +15 | +18 | +20 |
| Ex. 6 | Electrophotographic photosensitive member 6 | +5 | +15 | +14 | +12 | +8 |
| Ex. 7 | Electrophotographic photosensitive member 7 | +2 | +11 | +10 | +8 | +13 |
| Ex. 8 | Electrophotographic photosensitive member 8 | +2 | +10 | +12 | +8 | +2 |
| Ex. 9 | Electrophotographic photosensitive member 9 | +3 | +10 | +13 | +11 | +2 |
| Ex. 10 | Electrophotographic photosensitive member 10 | +3 | +14 | +13 | +9 | +5 |
| Ex. 11 | Electrophotographic photosensitive member 11 | +2 | +8 | +9 | +9 | +5 |
| Ex. 12 | Electrophotographic photosensitive member 12 | +3 | +10 | +12 | +9 | +9 |
| Ex. 13 | Electrophotographic photosensitive member 13 | −8 | +7 | −7 | −10 | −10 |
| Ex. 14 | Electrophotographic photosensitive member 14 | +3 | +12 | +12 | +8 | +3 |
| Com. Ex. 1 | Electrophotographic photosensitive member C1 | +10 | +24 | +24 | +27 | +35 |
| Com. Ex. 2 | Electrophotographic photosensitive member C2 | +20 | +24 | +22 | +24 | +30 |
| Com. Ex. 3 | Electrophotographic photosensitive member C3 | +10 | +25 | +25 | +26 | +35 |
| Com. Ex. 4 | Electrophotographic photosensitive member C4 | +18 | +25 | +22 | +25 | +32 |
| Com. Ex. 5 | Electrophotographic photosensitive member C5 | +12 | +23 | +26 | +18 | +28 |
| Com. Ex. 6 | Electrophotographic photosensitive member C6 | +6 | +14 | +17 | +20 | +33 |

In Table 1, the unit for all the numerical values is [V].

As can be seen from the results shown in Table 1, the electrophotographic photosensitive member 1 of Example 1 having an intermediate layer formed using the rutile-type acidic titania sol according to the present invention, shows better results concerning potential variation than the electrophotographic photosensitive member C1 of Comparative Example 1 having an intermediate layer formed without using the acidic titania sol according to the present invention.

In the electrophotographic photosensitive member C2 of Comparative Example 2 having an intermediate layer formed using only titanium oxide crystal particles having an average primary particle diameter of 15 nm, and without using the rutile-type acidic titania sol according to the present invention, good results concerning potential variation were not obtained. Therefore, it can be understood that potential variation cannot be sufficiently suppressed merely by incorporating titanium oxide particles having a small particle size into the intermediate layer.

That is, in order to suppress long-term potential variation, which becomes significant when images are formed in a low-humidity environment, and to suppress short-term potential variation, it is necessary that the intermediate layer is formed by the use of the rutile-type acidic titania sol according to the present invention.

In addition, from the results of Example 2, it can be seen that when both the rutile-type acidic titania sol according to the present invention and the titanium oxide particles having an average primary particle diameter of 13 nm or more to 60 nm or less are included in the coating liquid for an intermediate layer, the results concerning potential variation are further improved.

Furthermore, from the results of Example 8, it can be seen that when an azo pigment is included in the intermediate layer, the results concerning potential variation are even further improved.

While the present invention has been described with reference to exemplary embodiments and the examples, it is to be understood that the invention is not limited to the disclosed exemplary embodiments and examples. It will be also appreciated that many other embodiments of the invention may be possible without departing from the spirit or scope of the invention as defined in the claims.

This application claims the benefit of Japanese Patent Applications No. 2009-104859, filed Apr. 23, 2009 and No. 2010-093134, filed Apr. 14, 2010, which are hereby incorporated by reference herein in their entirety.

The invention claimed is:

1. An electrophotographic photosensitive member, comprising: a conductive support; an intermediate layer formed on the conductive support; a charge-generating layer containing a charge-generating substance, formed on the intermediate layer; and a hole-transporting layer containing a hole-transporting substance, formed on the charge-generating layer, wherein the intermediate layer is a layer formed by applying a coating liquid for the intermediate layer, the coating liquid containing an organic resin and a rutile-type acidic titania sol containing tin, and drying the applied coating liquid, and wherein the rutile-type acidic titania sol is an acidic sol containing particles of rutile-type titanium oxide crystal in which tin atoms are contained, the tin atoms replacing a part of the titanium atoms in the rutile-type titanium oxide crystal.

2. The electrophotographic photosensitive member according to claim 1, wherein the particles of rutile-type titanium oxide crystal further contain zirconium atoms, the zirconium atoms replacing a part of the titanium atoms in the rutile-type titanium oxide crystal.

3. The electrophotographic photosensitive member according to claim 1, wherein the rutile-type acidic titania sol is a hydrochloric acid sol.

4. The electrophotographic photosensitive member according to claim 1, wherein the organic resin is a polyamide.

5. The electrophotographic photosensitive member according to claim 1, wherein the rutile-type acidic titania sol is an acidic sol containing rutile-type titanium oxide crystal particles having an average primary particle diameter of 3 nm or more and 9 nm or less.

6. A method for producing an electrophotographic photosensitive member, comprising: an intermediate layer-forming step of forming an intermediate layer on a conductive support; a charge-generating layer-forming step of forming a charge-generating layer containing a charge-generating substance on the intermediate layer; and a hole-transporting layer-forming step of forming a hole-transporting layer containing a hole-transporting substance on the charge-generating layer, wherein the intermediate layer-forming step is a step of forming the intermediate layer by applying a coating liquid for an intermediate layer, the coating liquid containing an organic resin and a rutile-type acidic titania sol containing tin, and drying the applied coating liquid, and wherein the rutile-type acidic titania sol is an acidic sol containing particles of rutile-type titanium oxide crystal in which tin atoms are contained, the tin atoms replacing a part of the titanium atoms in the rutile-type titanium oxide crystal.

7. The method for producing an electrophotographic photosensitive member according to claim 6, wherein the particles of rutile-type titanium oxide crystal further contain zirconium atoms, the zirconium atoms replacing a part of the titanium atoms in the rutile-type titanium oxide crystal.

8. The method for producing an electrophotographic photosensitive member according to claim 6, wherein the rutile-type acidic titania sol is a hydrochloric acid sol.

9. The method for producing an electrophotographic photosensitive member according to claim 6, wherein the organic resin is a polyamide.

10. A process cartridge which integrally holds: the electrophotographic photosensitive member according to claim 1, and at least one unit selected from the group consisting of: a charging unit for charging the surface of the electrophotographic photosensitive member; a developing unit for developing an electrostatic latent image formed on the surface of the electrophotographic photosensitive member with toner to form a toner image on the surface of the electrophotographic photosensitive member; and a cleaning unit for removing the toner remaining on the surface of the electrophotographic photosensitive member after the toner image has been transferred onto a transfer material, the process cartridge being detachably mountable on a main body of an electrophotographic apparatus.

11. An electrophotographic apparatus, comprising: the electrophotographic photosensitive member according to claim 1, a charging unit for charging a surface of the electrophotographic photosensitive member; an exposure unit for irradiating the charged surface of the electrophotographic photosensitive member with exposure light to form an electrostatic latent image on the surface of the electrophotographic photosensitive member; a developing unit for developing the electrostatic latent image formed on the surface of the electrophotographic photosensitive member with toner to form a toner image on the surface of the electrophotographic photosensitive member; and a transferring unit for transferring the toner image formed on the surface of the electrophotographic photosensitive member onto a transfer material.

* * * * *